United States Patent [19]

Roberts et al.

[11] 4,386,765

[45] Jun. 7, 1983

[54] COMPOSITE MOULDED REFRACTORY ARTICLES

[75] Inventors: Michael A. Roberts; Martin Copperthwaite, both of Sheffield, England

[73] Assignee: USS Engineers and Consultants, Inc., Pittsburgh, Pa.

[21] Appl. No.: 313,437

[22] Filed: Oct. 21, 1981

Related U.S. Application Data

[62] Division of Ser. No. 206,582, Nov. 13, 1980, Pat. No. 4,323,529.

[51] Int. Cl.[3] ..... C21C 5/46

[52] U.S. Cl. ..... 266/236; 266/270; 266/287; 266/282

[58] Field of Search ..... 266/270, 280, 283, 287, 266/285, 286

[56] References Cited

U.S. PATENT DOCUMENTS

| | | | |
|---|---|---|---|
| 3,353,809 | 11/1967 | Snellman | 266/208 |
| 3,510,547 | 5/1970 | Eisler | 264/333 |
| 3,839,521 | 10/1974 | Robinson | 264/333 |
| 3,912,134 | 10/1975 | Poran | 251/144 |
| 3,926,406 | 12/1975 | Hind | 251/144 |
| 3,937,372 | 2/1976 | Bode | 251/144 |

*Primary Examiner*—L. Dewayne Rutledge
*Assistant Examiner*—Christopher W. Brody
*Attorney, Agent, or Firm*—John F. Carney

[57] ABSTRACT

A sliding gate valve slide plate in a can has an integral collector nozzle and is formed as two conjoined refractory concrete mouldings with a cup or trough shaped metal foil lying in the joint therebetween. The foil is oxidisable in service to form a bond between the concretes. The concretes may be of different formulations, and the moulding with which molten metal makes contact is preferably the more resistant to the rigorous environment presented by flowing molten metal.

The slide plate is cast in two steps using the shaped foil and the can as respective lost mould members which coact with a planar polished surface to produce a cast slide plate needing effectively no finish grinding before installation in a valve.

9 Claims, 6 Drawing Figures

COMPOSITE MOULDED REFRACTORY ARTICLES

This is a division of application Ser. No. 206,582, filed Nov. 13, 1980, now U.S. Pat. No. 4,323,529.

BACKGROUND OF THE INVENTION

The present invention relates to composite moulded refractory articles and their manufacture.

Articles with which this invention is concerned are such items as refractory bricks, well blocks, nozzles, valve plates and parts and fittings therefor, which molten metal streams contact in the course of teeming.

A recurrent problem in the teeming of molten metal, e.g. steel, is the erosion of refractories contacted by the flowing metal. The refractories include those forming the discharge outlet region of a ladle or tundish lining, and the plates and collector nozzles or pour tubes of sliding gate valves. Another problem, when pouring certain alloy steels such as A1-killed steels, is accretion of frozen metal and alumina on the refractories.

Hitherto, the aforementioned problems have been tackled by making the vulnerable parts from very costly high-temperature fired refractories. Usually, high alumina is chosen. For components especially likely to be degraded, e.g. the refractory parts of throttling valves, even more expensive zirconia inserts or liners have sometimes been incorporated in the refractory parts owing to the high resistance of zirconia to molten metal attack.

It has been shown for slide gate valve plates that, apart from surface zones most adjacent the areas which come into contact with molten metal, the plate temperatures are usually well below 1000° C. Nevertheless it has been usual to make valve plates in entirety from refractories capable of withstanding very much higher temperatures. This is unnecessarily wasteful. Much lower duty and cheaper refractories would be quite adequate except adjacent metal contact regions. It is believed other refractory items could be made more economically if the bulk thereof were made from lower duty refractories while their metal contact surfaces are made from higher duty refractories.

Further it may be mentioned that, as regards sliding gate valve plates, in general no more than 40% or so of their sliding surface areas are ever likely to be exposed to molten metal. No more than 25% or so of their volumes is likely to be exposed to temperatures above 1000° C. Thus, only a limited quantity of higher duty refractory is actually necessary for a sliding gate valve plate to perform satisfactorily.

SUMMARY OF THE INVENTION

This invention aims to rationalise the manufacture of refractory items with which molten metal streams make contact, by making such items as composite bodies of low and high duty materials, the former predominating and the latter being confined to those surface regions exposed to molten metal.

Usually, components with which the invention is concerned have been subjected to high temperature firing —normally to 1600°-1900° C. Generating such temperatures is energy intensive and hence very costly. The invention aims to minimise the energy expenditure and, at least in the manufacture of valve plates, to avoid or substantially minimise finishing and sizing grinding operations.

According to the present invention, there is provided a refractory article having a surface portion which, in service, is contacted by a molten metal stream, comprising an integral composite body having a first refractory member providing the said surface portion, a trough or cup shaped metal foil encompassing the first refractory member, and a second, back-up refractory member supporting the foil-encompassed first refractory member, the first refractory member being made from a higher duty refractory material than the second refractory member.

The invention also provides a method of making a refractory article having a surface portion which, in service, is contacted by a molten metal stream, including the steps of (i) forming a first mould space from a trough or cup shaped metal foil and a companion, permanent mould member the shape of which is a negative of said surface portion, (ii) filling said first mould space with a mouldable refractory concrete and at least partially curing the concrete; (iii) assembling the foil and moulding therein in a second mould space formed from companion mould members; (iv) filling the second mould space with a second refractory concrete, which is of lower duty than the first concrete; and (v) curing the second concrete and, to the extent that it may not already be completely cured, the first concrete also.

For example, the invention embraces a form of sliding gate valve plate in which there is an integral collector nozzle, the first refractory member occupying only a portion of the sliding surface of said plate adjacent and surrounding an orifice thereof and being flush with the remainder of the sliding surface, the first member further providing a protective surface layer for the orifice and for at least part of the flow passage of the collector nozzle.

A canned valve plate of this form can be made by a method in which the first concrete is poured into a first mould space defined by a core, the shaped foil and a permanent mould member having a smooth, polished scratch-resistant surface, to produce a first concrete moulding having an orificed nose and a peripheral flange at one end replicating the said surface of the permanent mould member; and in which the second concrete is poured into a second mould which is constituted by a metal can defining the external shape desired of the plate and its nozzle, the permanent mould member having a smooth, polished and scratch-resistant surface, and the foil-encased first moulding and core, to produce a second concrete moulding in which the foil-encased first moulding is embedded and of which the can is an integral part, the two mouldings having their respective surfaces, which replicate said permanent mould member surface, flush with one another.

Advantageously, the foil is a metal which oxidises in service, its oxide being capable of forming slag or ceramic bonds to the two refractory members.

Exemplary metals are iron or steel and aluminum respectively.

DESCRIPTION OF PREFERRED EMBODIMENTS OF THE INVENTION

Manufacture of refractory components which are subjected to the rigours of flowing molten metal such as steel involves two moulding operations using two different refractory concretes. One concrete is of higher duty than the other i.e. it is formulated to have greater resistance to molten metal attack and erosion, and will be the more costly. This concrete is confined to those component regions where molten metal attack is at its most severe. The low duty concrete may predominate in components according to the invention, the high duty concrete being but a small fraction of the total volume of the components. In at least a first of the two moulding operations, a mould member becomes an integral part of the moulding, and remains in situ in the finished component.

Purely for illustration, the invention is described hereafter in connection with the manufacture of valve plates having integral collector nozzles. It will be recognised that plates without collector nozzles can also be made by the method in accordance with the invention. Other composite refractory articles embodying the invention, such as well blocks and nozzles, can likewise be made by the present method with the aid of suitably shaped moulds.

The method to be described is performed in such a way that the valve plate 10 is formed in situ in and is bonded to its outer steel reinforcing can 11. Subsidiary grinding operations of the sliding surface 12 of the plate—either for truing the surface for leak-highness or for sizing—are eliminated or minimised substantially.

Figure 1:
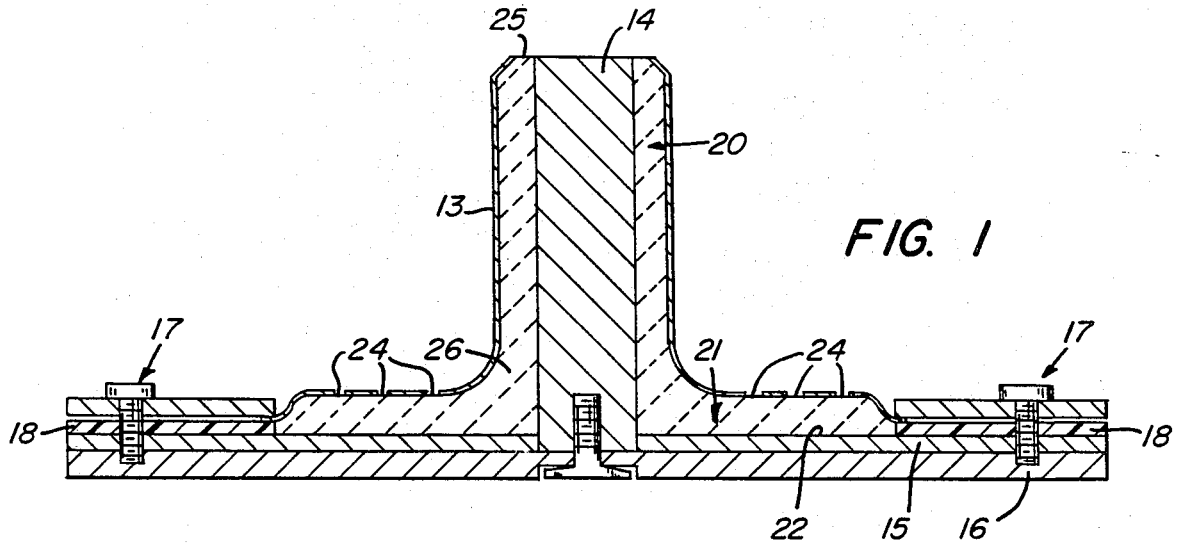
FIG. 1 illustrates a first moulding operation and equipment for producing a composite valve plate according to the invention.

The first moulding operation is performed in a mould, as shown in FIG. 1, consisting of a temporary mould member 13 and permanent mould members 14, 15 and 16. Clamping means 17 of any convenient type (shown simply as screws threaded into mould member 16) hold all the mould members fastened together. A gasket 18 not only prevents the escape of moulding concrete but also ensures that a peripheral flange 19 (see FIG. 2) of mould member 13 is set back from mould member 15.

Mould member 13 is a shaped, thin metal foil article, made e.g. from aluminum or tinplate, and tinplate, and usually no more than a few mils in thickness. Member 13 is cup or trough shaped and in this case combines both forms. A moulding formed inside this member 13 has a nose 20 projecting from an encircling peripheral flange 21, the latter faithfully reproducing or replicating the surface 22 of mould member 15. So that the finished valve plate 10 can pass molten metal, mould member 14 is a core disposed coaxially in member 13. The core extends wholly through the first mould and is bolted securely to mould member 16 which forms a rigid base for the mould. Mould member 15 is a sheet of any convenient material which has a true, level and smooth or polished surface 22. Polished metal, float or plate glass or Perspex (R. T. M.) can constitute mould member 15.

The mould space bounded by members 13, 14 and 15 is filled with refractory concrete using vibration to assist complete void-free filling, concrete being admitted through the open top 25 of member 13. So that air can escape when filling the mould, member 13 is apertured at 24.

After filling the mould, its concrete contents are at least partially cured, to a state such that the concrete moulding 26 is capable of retaining its integrity, ordinarily by heating at a temperature dependent on the nature of the concrete.

Thereafter the clamping means 17 is removed and, without disturbing moulding 26 or mould member 15, a second mould member which defines the external shape of the desired plate construction is clamped—about the core 14, moulding 26 and foil member 13—to the mould members 15, 16. The second mould member consists of a metal can 11 of conventional shape. A clamping arrangement 17' secures can 11 to mould members 15, 16 and a sealing gasket 18' is again provided to ensure that can 11 is spaced from surface 12 of the final moulded plate 10. Air venting holes 24' are provided in can 11.

The mould space bounded by can 11, foil 13 and plate 15 is filled, with a second concrete mix, as before and lastly the composite is subjected to a final curing step. During this step, the second concrete is cured as well as the first concrete, to the extent that this has not already been cured completely. Upon completion of curing, the clamping arrangement is removed and the moulded, canned valve plate is stripped from mould members 14, 15 and 16.

In the finished valve plate 10, the shaped foil 13 is embedded in the back-up or outer concrete moulding 28, including its peripheral flange 19, and is thus isolated from contact with molten metal. The valve plate surface 12 accurately replicates the surface 22 of mould members 16, 16' and appears smooth, level and shiny overall, with no superficial discontinuity between the two mouldings 26, 28. Molten metal leakage between two companion valve plates made as described above is absent.

By using gaskets 18, 18' of appropriate thickness, valve plates can be made to fit exactly in standard valve mechanisms without the plates first having to be ground to size. For assuring dimensional reproduceability, the clamping means 17, 17' can include or be associated with limit stops or gauging pieces, not shown.

With suitable choice of concretes, satisfactory bonding to the shaped foil 13 and to the can 11 is achieved. For additional safety, foil 13 and can 11 can be keyed to the concretes. In the case of shaped foil 13, it may be puckered or wrinkled for keying; can 11 may have in-turned lips or tangs for keying.

When the valve plate is exposed to service temperatures, it is expected that foil 13 will tend to oxidise. This can be positively advantageous, for the resulting oxide may actually bond the two concrete mouldings 26, 28 together. If foil 13 is aluminum, a ceramic bond can be formed, whereas if it is iron (tinplate) a slag bond will result.

As described above, the refractory composite has two conjoined mouldings. For some applications, the composite could be the result of more than two consecutive moulding operations. A shaped foil will be located between at least one pair of contiguous mouldings, if not between each pair.

For composite articles other than valve plates, surface finish may be less critical and moulding against polished surfaces may be unnecessary. Generally, however, surface finish should be as good as practically feasible especially for surfaces contacted by flowing molten metal.

The thin foil member 13 is relatively fragile. To protect it during preparation for and performance of the first moulding operation, a rigid protective former may be fitted snugly around it. The former is, of course, removed prior to assembly of the foil member and its concrete filling 26 in the second mould.

Suitable concretes for mouldings 26 and 28 can be hydraulically or chemically bonding types curable at room temperature or at only moderately elevated temperatures, e.g. 100°-150° C. or up to 400° C. or so depending on the bonding mechanism. It is not essential for both concretes to exhibit the same type of bonding mechanism. Should the concrete mouldings demand curing at different temperatures, moulding 26 should consist of concrete which cures at the higher temperature. Otherwise, to expose it to the higher temperature (after it has cured) following completion of the second moulding operation could cause it to degrade and give rise to service problems.

The concrete forming moulding 26 which comes into contact with flowing molten metal should be a higher duty formulation than the concrete forming moulding 28. That is, the former concrete should be better able to resist high temperatures, molten metal and slag attack, and erosion. It should be volumetrically stable up to 1500° C. whereas the low duty concrete should be volumetrically stable up to 1000°-1200° C. The low duty concrete forming moulding 28 will desirably have a lower thermal conductivity than the other concrete.

Aggregates for the concrete used in the first moulding operation can be selected from alumina, mullite, aluminosilicates containing 50% or more alumina by weight, magnesia, magnesium aluminate, zircon, zirconia, refractory carbides and combinations of two or more thereof. Preferred aggregate materials are sintered and fired alumina, sintered and fired mullite, sintered and fired magnesia, zircon and zirconia.

Aggregates for the concrete used in the second moulding operation can be selected from basalt, olivine, blast furnace slags, firebrick grogs containing 25 to 40% of alumina by weight, chamotte, calcined clays, flint clays, bauxite and combinations of two or more thereof. Preferred aggregates are firebrick grog containing 25 to 45% alumina and calcined clays.

The concretes can employ inorganic or organic binders. The former can include silicates, sulphates, nitrates, chlorides and phosphates, phosphorus pentoxide or phosphoric acid. Organic binders can include alkali metal lignosulphates and pitch-based materials.

Figure 2:
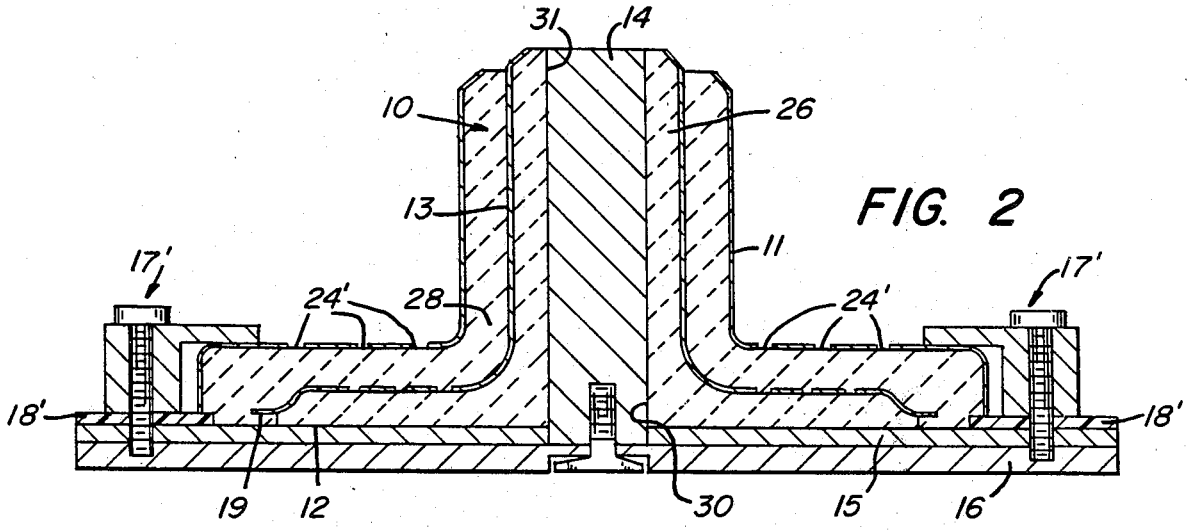
FIG. 2 illustrates a second moulding operation and equipment for completing the composite valve plate.
Figure 3:
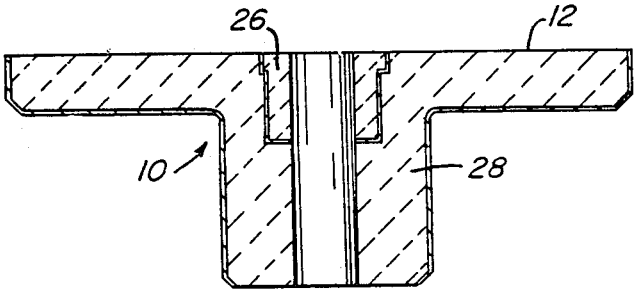
FIGS. 3 to 6 illustrate four alternative composite valve plate constructions according to the invention.
Figure 4:
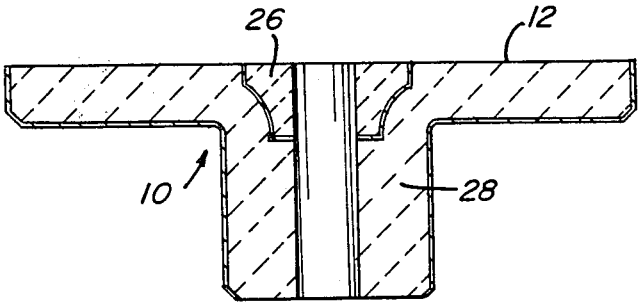
Figure 5:
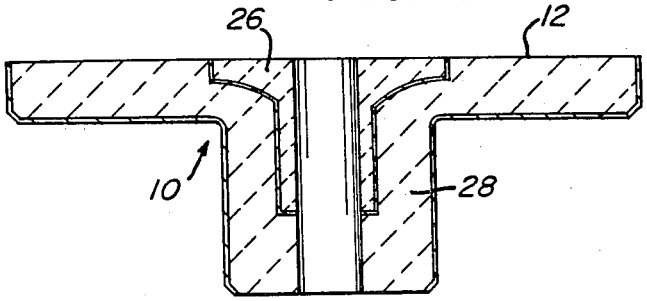
Figure 6:
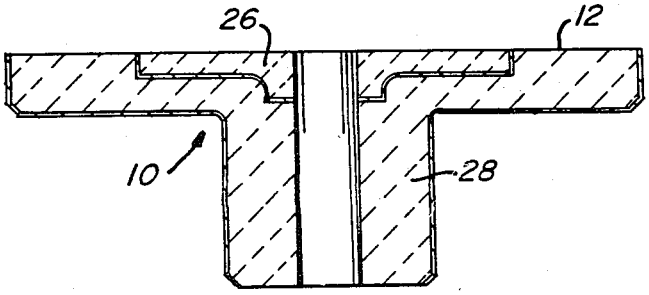

In the finished valve plate seen in FIG. 2, the high duty concrete (moulding 26) occupies the plate region which metal may contact in the course of opening and closing valve movements. It also defines the plate orifice 30 and the entire length of nozzle bore 31. Depending on expected service conditions, the high duty concrete may not need to define the entire bore length. Nor, in some cases, need it occupy the entire plate region which metal contacts. Thus, it could occupy only the region adjoining the plate orifice, this being the area most prone to erosion under stream-throttling conditions. Exemplary and by no means exhaustive alternative valve plate configurations are sketched in FIGS. 3 to 6. In these illustrations, their shaped foils 13 and metal cans 11 have been omitted merely for simplicity of drafting.

Any of the plate configurations shown in the drawings can be modified to suit a valve top plate by omitting the nozzle extension. The shaped foil will then lend towards a trough rather than a cup shape.

We claim:

1. A refractory article having a surface portion which, in service, is contacted by a molten metal stream, comprising an integral composite body having a first refractory member providing said surface portion, a second, back-up refractory member supporting said first refractory member, and a metal foil interposed between said first and second refractory members, said foil being formed of a metal that oxidizes in service, to effect the formation of slag or ceramic bonds to the two refractory members.

2. A refractory article according to claim 1 in which the first refractory member is made from a higher duty refractory material than the second refractory member.

3. A refractory article according to claim 1, in which the metal foil is embedded in or otherwise shielded by the second refractory member and is thereby isolated from contact with molten metal.

4. A refractory article according to claim 1, in which the two refractory members are made from mouldable, hydraulically or chemically-bonded refractory concretes, the concrete of the second member being curable at a lower temperature than the concrete of the first member.

5. A refractory article according to claim 1, in which the metal foil is puckered or wrinkled to assist bonding of the two refractory members thereto.

6. A refractory article according to claim 2, in which the first refractory member contains refractory material selected from alumina, mullite, alumino-silicates containing 50% or more alumina by weight, magnesia, magnesium aluminate, zircon, zirconia, refractory carbides and combinations of two or more thereof.

7. A refractory article according to claim 6, in which the second refractory member contains refractory material selected from basalt, olivine, blast furnace slags, firebrick grogs containing 25 to 45% of alumina by weight, chamotte, calcined clays, flint clays, bauxite and combinations of two or more thereof.

8. A refractory article according to claim 1, in the form of a sliding gate valve plate with an integral collector nozzle, the first refractory member occupying only a portion of the sliding surface of said plate adjacent and surrounding an orifice thereof and being flush with the remainder of the sliding surface, the first member further providing a protective surface layer for the orifice and for at least part of the flow passage of the collector nozzle.

9. A refractory article according to claim 8, in which the first member forms a protective surface layer for the entire length of the flow passage.

* * * * *